United States Patent [19]

Bartz

[11] 4,250,996

[45] Feb. 17, 1981

[54] USE OF CHEMICALLY MODIFIED POLYOLEFINS FOR BONDING NAILS TOGETHER IN A CONFIGURATION SUITABLE FOR USE IN A POWER DRIVEN NAILER

[75] Inventor: Kenneth W. Bartz, Baytown, Tex.

[73] Assignee: Exxon Research and Engineering Co., Florham Park, N.J.

[21] Appl. No.: 659,317

[22] Filed: Feb. 19, 1976

Related U.S. Application Data

[63] Continuation of Ser. No. 340,446, Mar. 12, 1973, abandoned.

[51] Int. Cl.[3] ..... B65D 85/24

[52] U.S. Cl. ..... 206/343

[58] Field of Search ..... 206/340, 343, 344; 260/878 R

[56] References Cited

U.S. PATENT DOCUMENTS

| | | | |
|---|---|---|---|
| 1,557,121 | 10/1925 | Vogel | 206/340 |
| 3,152,334 | 10/1964 | Lingle | 206/344 |
| 3,162,871 | 12/1964 | Powers | 206/343 |
| 3,625,352 | 12/1971 | Perkins | 206/344 |
| 3,676,190 | 7/1972 | Landler et al. | 260/878 R |
| 3,696,069 | 10/1972 | Schrage et al. | 260/878 R |
| 3,696,169 | 10/1972 | Schrage et al. | 260/878 R |
| 3,699,186 | 10/1972 | Schrage et al. | 260/878 R |
| 3,701,751 | 10/1972 | Schramm et al. | 260/42.28 |
| 3,862,265 | 1/1975 | Steinkamp et al. | 260/878 R |
| 3,966,042 | 6/1976 | Shelton et al. | 206/344 |

*Primary Examiner*—William R. Dixon, Jr.

*Attorney, Agent, or Firm*—Myron B. Kurtzman; David A. Roth

[57] ABSTRACT

Improved fastener articles, comprising a plurality of preferably rod-shaped fastener elements, such as nails or staples, are maintained in a predetermined configuration by bonding them together with one or more of either strips, films, or powdered particles of a specially formulated, adherent polyolefin copolymer. These fastener articles are especially adapted for use in automatic dispensers, i.e. nailers or staplers.

28 Claims, 3 Drawing Figures

USE OF CHEMICALLY MODIFIED POLYOLEFINS FOR BONDING NAILS TOGETHER IN A CONFIGURATION SUITABLE FOR USE IN A POWER DRIVEN NAILER

CROSS REFERENCE TO RELATED APPLICATIONS

This application is a continuation of application Ser. No. 340,446 filed Mar. 12, 1973, now abandoned.

PRIOR ART

Automatic nailers, especially those which are actuated pneumatically, are a relatively new innovation in the building industry. But they are finding wide acceptance and it is contemplated that the market will grow quite rapidly.

These automatic nailers require nails which are held together in a prearranged configuration so that they may be conveniently fed into the nailer itself and can be "processed" properly within the nailer. The prearranged configuration in a specific aspect is referred to as a nail stack. The concept is quite analogous to cartridges held in a belt which are fed into a heavy caliber machine gun. Thus, by "processed" it is meant that the nails in the stack have to move cleanly in the chamber and into firing position. The device used to feed the stack is a spring loaded arrangement. (And, indeed, the inventive concept herein could be utilized for the purpose of adhering machine gun bullets, if so desired, provided relatively heavy duty polyolefin based adhesives which have been specially formulated to adhere to brass are used.)

Most nail stacks presently available utilize a hot-melt adhesive which bridges the interstices between adjoining nails in the stack. Paper strips are placed on one or even both sides of the stack. Such strips are required in order to increase the rigidity of the nail stack but these strips also contribute towards improved appearance.

Nail stacks prepared according to these techniques of the art suffer from several major disadvantages. Some of these include:

(i) when exposed to low temperatures, which are common to building activity which takes place outside, the adhesives undergo brittle failures when dropped or during loading and cause extensive stack breakage;

(ii) the same adhesives will also tend to break away from the nail during the firing process with sufficient velocity to constitute a safe problem, to say nothing of the additional clean-up problems;

(iii) very often a portion of paper strip, with an area exceeding that of the nail head, will be caught by the nail and pinned underneath the nail head, requiring additional manpower to remove it prior to the finishing steps of plastering, etc.

Thus, a potentially enormous and significant automatic fastening industry is waiting poised at the threshold of major significance. Any improvements that can be effected upon the unsolved disadvantages attendant upon the presently available nail stack itself will accelerate that growth.

Furthermore, an additional related problem is in the area of staples which are used either in automatic dispensers or hand-operated dispensers for a wide variety of uses.

These are conventionally bonded together into a fastener article having a plurality of rod elements rigidly bonded to each other in an adjacent planar, parallel relationship. Usually, in order to bond, the wires are cleaned in a solvent bath, dried, and exposed to an adhesive tank.

Conventionally, nitrocellulose is used as the adhesive to bond the rod or wire elements of a staple fastener article. This is not a particularly effective adhesive. Moreover, it is applied from a solvent/nitrocellulose solution. The solvent is removed by passing the wires through a series of electrical heaters (ovens) since the solvent is not recovered (recycled) but vented to the atmosphere. This presents a difficult problem of complying with increasingly stringent solvent emission standards promulgated by various governmental regulatory agencies.

SUMMARY OF THE INVENTION

The invention comprises a fastener article of manufacture, which is an assemblage of rod-shaped, fastener elements suitable for use in automatic dispensing devices for dispensing fastener elements such as nails or staples. These elements are held properly together in a prearranged configuration by virtue of a specifically defined adhesive polyolefinic composition.

DESCRIPTION OF THE INVENTION WITH PREFERRED EMBODIMENTS

Figure 1:
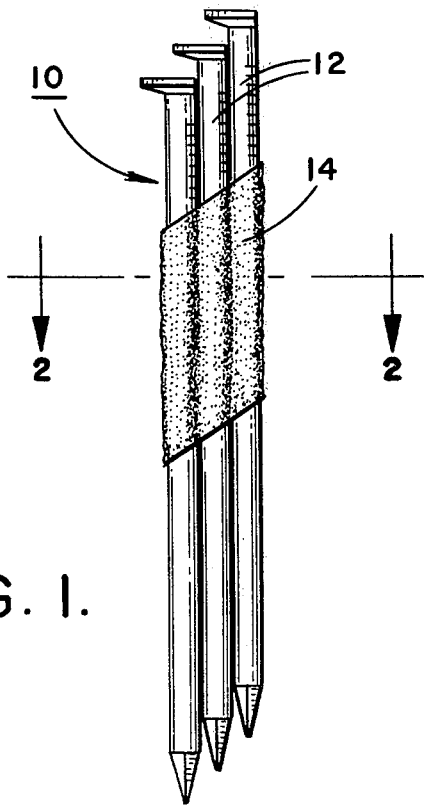
FIG. 1 shows an enlarged view of a typical portion of fastener elements, e.g. nails comprising the article of manufacture of the invention.

It has been discovered and forms the substantial conceptual basis of this invention, that a novel, unobvious and highly useful fastener article of manufacture can be prepared according to the invention. In essence, fastener articles arranged and constructed in specific configurations and held together with specifically defined bonding agents and techniques comprise the subject matter of the invention.

In particular, the novel fastening articles of the invention are a plurality of individual fastening elements, e.g. nails, rods or staples especially adapted to be driven into a substrate material by automatic driving means such as pneumatic actuated automatic nailers.

These elements are firmly held in a specific and prearranged structure and relationship to form the fastener article by means of certain adhesive binders comprising a major portion of $C_2$ to $C_8$ polyolefin graft copolymers used as tapes, film or powder. These latter are referred to generally as adhesives.

When used herein the term copolymer is intended to include polymers with two or more monomers.

In one preferred aspect the binder, when used as a tape, comprises a major portion of $C_2$—$C_3$ polyolefin copolymer strip 1 mil to 40 mils, preferably 5 mils to 30 mils, and most preferably 6 mils to 20 mils thick, having a width sufficient to cover from 5 to 75, preferably 20 to 60, and most preferably 30 to 40% of the length of the fastener elements, e.g. nail shanks.

It is most desirable and therefore preferred that the tape covers both sides of the fastener article, e.g. nail stack.

The polyolefin copolymer is preferably grafted rather than randomly copolymerized (but not limited to grafts) with certain reactive compounds as described herein. The adhesive component, e.g. graft, content will be from about 0.12 to 20, preferably 1 to 10 and most preferably 2.0 to 8 weight percent of the total polymer.

Preferably this adhesive component of the composition, e.g. graft portion, will comprise the class of unsaturated mono- and carboxylic-containing acids ($C_3$–$C_{10}$) with preferably at least one olefinic unsaturation, and will include anhydrides, salts, esters, ethers, amides, nitriles, thiols, thio acids, glycidyl, cyano, hydroxy, glycol, and other substituted derivatives from acids.

Preferred examples of such acids, anhydrides, and derivatives thereof include maleic acid, fumaric acid, himic acid, itaconic acid, citraconic acid, acrylic acid, glycidyl acrylate, methacrylic acid, glycidyl methacrylate, cyanoacrylate, hydroxymethacrylate, acrylic polyethers, acrylic anhydrides, sodium acrylate, calcium acrylate, magnesium acrylate. Substituted styrenes, acrylonitrile, vinyl halides, acrylate esters, dimethyl aminoethyl acrylate, vinyl pyridines, vinyl pyrrilidone, vinyl ether copolymers, maleic anhydride-styrene copolymers, acrylamide, strained ring diels-alder adducts such as ethylidene norbornene and the like are other unsaturated grafting monomers which can be usefully employed.

Acrylic acid and glycidyl acrylate are especially preferred species of monomeric grafting agent.

Although random copolymers and grafted copolymers can be prepared utilizing any known technique in the art, a particularly preferred technique for preparing the preferred grafted copolymer binders of the invention is that developed by Steinkamp and Grail, who have described their grafting technique in full in a commonly assigned application, Ser. No. 240,494, entitled "Polymers with Improved Properties and Process Therefor" filed Apr. 3, 1972, now U.S. Pat. No. 3,862,265, issued Jan. 21, 1975, which patent is incorporated herein in its entirety by reference.

It will be recognized that a wide variety of polyolefin copolymer materials will be suitable so long as they will adhere well to the individual fastener elements, e.g. rods, i.e. nails. Nevertheless, certain physical criteria defining especially preferred polyolefins will be described. Such polyolefins will produce fastener articles of outstanding commercial value.

Among these is the prerequisite that the tape be made to have adequate toughness or flexural strength, e.g. an ASTM D790 secant flexural modulus (p.s.i. $\times 10^5$) of 1.8 to 0.5, preferably 1.5 to 0.5, and most preferably 1.20 to 0.6. The D790 test gives an indication of the flexibility of the adhesive binders.

The preferred material will have an ASTM D256 izod room temperature impact strength in foot/pounds per inch of notch of 0.6 to DNB*, preferably 1.3 to DNB, and most preferably 1.5 to DNB. Over the temperature range of −40° to 150° F., preferably −20° to 130° F., and most preferably −10° to 110° F., the unnotched izod impact values range from 6 to DNB. The D256 test indicates the resistance of the binder material to shattering at low temperatures.

* DNB=Does Not Break

The other important criteria is the ASTM D638 tensile strength measured in psi, which is 6,000 to 1500, preferably 4,000 to 1,700, and most preferably 3,000 to 1,800.

Furthermore, the adhesion values should be on the order of at least 3 and can be up to 60, preferably at least 10 and can be up to 30, at least and most preferably 20 pounds per square inch, e.g. so that the grafted binder adheres to the fastener, i.e. nail, as it is being nailed and even after nailing. This is to ensure that no polymeric material is forced off the surface of the nail. Thus the use of the inventive article eliminates accumulations under and extending beyond a nail head.

For nail stacks, a very crude and practical test is to drop a nail stack fastener article of the invention, such as that in FIG. 4, with about 30—40 nails in it, from a height of about four feet. The binder composition is considered to perform satisfactorily if no catastrophic breakage occurs.

Furthermore, the polymeric tape material should not shatter and spray tape fragments as the individual fastener elements of the fastener article are actually driven into various materials for fastening purposes.

Specifically, in terms of nails, the nail itself must penetrate the material to be nailed, carry the grafted tape with it and at the same time the tape-to-nail adhesion must be tenacious enough not to separate during the actual automatic nailing step.

Not only are the fastener articles of manufacture of the invention possessed of outstanding utility for use in automatic fastener dispensers, the invention also provides an extremely important process advantage of great ease of manufacturing the assembly of fastener elements comprising the fastener articles, than had been possible of the prior art.

Thus, a grafted polyolefin tape meeting the physical and other criteria set forth herein which is capable of being strongly adhered to the surface of the nail or other fastener element can be applied to fastener elements in at least two extremely convenient ways.

One of these is that the nails are assembled in their prearranged configuration. The tape is placed on the surface of the nails and the entire assembly is subjected to sufficient heat either by heating the nails or by placing the assembly in an oven so that the tape is able to soften and flow enough to adhere tenaciously to the surface of the nail after solidification.

This also preferably permits some of the tape material to flow into the interstices between the adjacent nails in the assembly. Such flow contributes toward maximizing the surface area of nail adhered to binder, e.g. tape. The exact conditions will vary somewhat depending on the particular fastener elements to which the tape is being fixed and the exact composition of the tape.

Alternatively, the tape itself can be extruded directly while the fastener elements are held in a jig or other device in their prearranged configuration. The soft, extruded tape will be laid down over the fastener element, e.g. nail surfaces, and will tenaciously adhere to these surfaces upon cooling. The nails can be preheated to a predetermined temperature so that the extruded tape is not initially cooled too rapidly to develop proper adhesion. Quenching a molten tape after a heat soak of a few minutes on the fastener element develops maximum adhesion values, but it is not necessary; less than maximum adhesion values are perfectly adequate for the purposes of this invention.

Although polyolefin copolymer tapes as described above are the preferred means for adhering fastener elements together to form the fastener articles of the invention, other techniques of utilizing the copolymer are available and can be used to form novel fastener articles.

One approach which can be used is to coat the individual fastener elements with a thin partial or complete coating of the adhesive polyolefinic copolymer. The coating can be accomplished with solution, extrusion or powder techniques.

The coated elements are then placed into then prearranged configuration proximities by any convenient means as described, such as a jig, subjected to sufficient heat to cause flow of the coating and cooled passively or actively to obtain fastener articles.

The elements can also be placed in their prearranged configuration, coated with a polyolefin copolymer powder either electrostatically or in a fluid bed, heated to cause flow of the coating and cooled passively or actively to obtain a fastener article.

Although the technique described in the paragraph immediately above can be used for nail stack fastener articles, it is especially preferred when the fasterner article is to be a planar configuration of staples for staple guns.

Although the articles and techniques of this invention generically encompass both staple configurations and nail stacks, there are enough differences in specifics to justify discussion of a particular technique which is especially well adapted for forming staple fastener articles.

Staple fastener articles with good dispensing properties can most conveniently be prepared by first arranging a large number of staple elements in a touching, adjacent, parallel, planar relationship. Subsequently, a film or binder (as described herein) is placed over the staples.

Heat is applied either by heating in an oven, or directly heating the staples sufficient to cause the film to soften and flow. Upon cooling, the staples are held in the prearranged configuration by the adhesive quality of the film.

Alternatively, the film can be melt-extruded directly on the heated staples or other fastener element. A tape can be used in the same manner.

It is also to be noted that for many fastening applications the functional binder copolymer material used on a fastener element will also adhere to the surface of the materials it penetrates because of the interaction of the binder's functional groups, e.g. carboxy with the functional nature of the host material, i.e. wood, steel, etc. See FIG. 3.

In the Figures,

FIG. 1 shows partial fastener article 10 (nail stack) with Nails 12 and the adhesive polyolefin tape 14 of the example bonded to the nails and holding them in their prearranged configuration.

Figure 2:
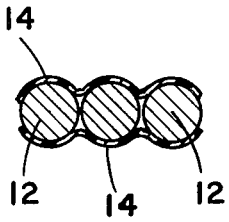
FIG. 2 shows a cross-sectional view of the article of FIG. 1 taken across 2—2.

FIG. 2 is a cross-section view of FIG. 1 taken across 2-2.

Figure 3:
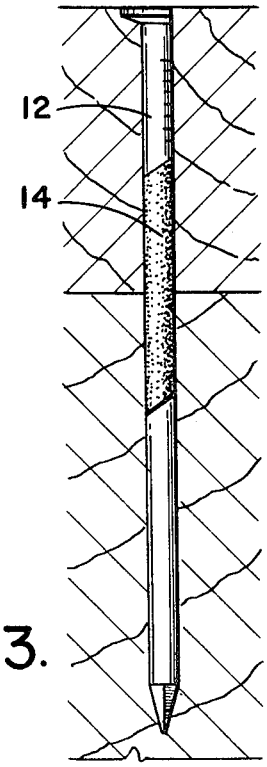
FIG. 3 shows a fastener element of the invention embedded in two pieces of wood which it is joining together.

FIG. 3 shows two pieces of wood held together by a fastener element (nail) from the nail stack.

The especially preferred compositions used in the articles of the invention will contain portions of plastic and elastomer as set forth in TABLE I below.

TABLE I

| Ranges | Plastic | Elastomer |
|---|---|---|
| | Isotactic polypropylene*, or high density PE | Ethylene, propylene, copolymer, or butyl or polyisobutylene, or other compatible elastomers |
| General | 30 to 90 wt. % | 70 to 10 wt. % |
| Preferred | 40 to 80 wt. % | 60 to 20 wt. % |
| Most Preferred | 50 to 70 wt. % | 30 to 50 wt. % |

*(including thermoplastic impact grades and block copolymer impact grades that can be used without additional additives)

It will be noted that the preferred compositions of the invention comprise a sizeable elastomeric component. This plays an important role in the rheology of the adhesive binder as well as the level of adhesion strength.

The elastomer EPR or EPDM copolymers will contain from 20 to 95, preferably 40 to 80, and most preferably 50 to 80 weight percent of ethylene. Generally it is preferred that they have a high crystalline component, e.g. high green strength. The type and quantity of elastomer is not critical, so long as the final composition has the specified proportions.

Blends of ethylene polymers and propylene polymers can also be used as the plastic component. They will comprise from 50 to 90 weight percent polypropylene and 50 to 10 weight percent polyethylene, preferably 50 to 85 weight percent polypropylene and 15 to 50 weight percent polyethylene, and most preferably 60 to 75 weight percent polypropylene and 40 to 25 weight percent polyethylene. The polyethylene component can be either high density or low density.

The grafted or copolymer portion of these polymers will preferably be acrylic acid or glycidyl acrylate and will be present in quantities of 0.2 up to 20 weight percent as described above. While the polymers can be grafted directly to the desired level, it is often convenient to graft a polymer to a relatively high level and then blend it with ungrafted polymer to arrive at the particular desired level. This is particularly useful when relatively low graft levels are required.

Although the adhesive binder compositions described herein will adhere extremely well to all ferrous metals and most nonferrous metals, special subgenus compositions within the scope of the generally described binder compositions are necessary to achieve necessary adhesion to copper and copper-containing alloys.

The binder composition that must be used to effectively bond copper fastener elements or any other copper item or coppercontaining alloy for that matter is as follows:

Generally, it has been found that blends of 60 to 97, preferably 80 to 95, and most preferably 85 to 90 weight percent of a low density polyethylene blended with a balance of butyl rubber or polyisobutylene and then grafted with from about 0.02 to 20, preferably 0.1 to 10, and most preferably 0.2 to 8 weight percent of acrylic acid or glycidyl acrylate will adhere well to copper or copper alloy substrates. Glycidyl acrylate grafts to polypropylene containing a small ethylene polymer component are particularly outstanding for achieving maximum copper adhesion. These novel copper-adhering compositions are described in detail in a copending commonly filed application entitled "Copper Adhesion Compositions," now Ser. No. 746,930 filed Dec. 2, 1976, being a continuation of Ser. No. 554,276 filed Feb.

28, 1975, which in turn is a continuation of original application Ser. No. 340,061 filed Mar. 12, 1973.

In formulating the adhesive binders of the invention, it was found that there was a delicate balance or trade-off between fullcontact of binder with fastener elements and melt-strength. The final composition must be satisfactory in both regards.

Melt-strength is important since the binder will often be applied under kinetic conditions, when it is molten. And it must have the ability to hang together when being stressed and moved while molten.

On the other hand effectiveness of adhesion depends on maximum contact of the binder with fastener elements. Therefore, the binder must flow to some extent while molten to achieve best results.

A rough measure of these characteristics can be obtained by measuring either melt index (MI) or melt flow rate (MFR), which for the purposes of this discussion will be considered interchangeable and will be referred to as MFR.

Generally, the novel adhesive binder of the invention should have a MFR of about 1 to 30, preferably 5 to 20, and more preferably 8 to 12.

When elastomer is blended into a given plastic, the resulting MFR will tend to be lower than the MFR of the starting plastic. Therefore, generally, a plastic is fabricated (by perioxide break-down for instance) with a higher MFR than is desired in the final composition.

A wide variety of elastomers can be used for blending with the plastic. These are largely amorphous materials which provide additional flexibility to absorb the shock of impact, particularly at low temperatures when the plastic component approaches or exceeds its glass transition temperature.

Generally, the elastomers are selected because of convenience in blending with the plastics, particularly when only extruder mixing is available. Also, the saturated elastomers, or low unsaturated elastomers (EPR, EPDM) are usually preferred over the highly unsaturated elastomers, e.g. natural rubber, polybutylene, etc.

The invention is further illustrated by the following examples.

EXAMPLE 1

In a preferred embodiment, the fastener article of FIG. 1 comprising a plurality of nails held in a flexible, pre-arranged configuration was prepared by the following technique.

The nails were placed in a jig in the prearranged configuration. A strip of grafted polyolefin tape $\frac{3}{8}''$ wide, 6 mils thick, consisting of 60 weight percent high molecular weight isotactic polypropylene having a MFR of between 1—22 and 40 weight percent ethylene-propylene elastomer (EMD-492, obtained from Exxon Chemical Co. U.S.A.), both of which were grafted with 4 weight percent of acrylic acid, to result in a grafted adhesive composition having a MFR of ~10, was used to hold the nails in the proper configuration. The polyolefin tape had an ASTM D638 tensile strength of 2,000 psi, an ASTM D790 secant flexural modulus of 75,000 psi, and a notched Izod ASTM D256 room temperature impact of 1.7 ft. lbs/inch.

The tape was placed over the nails which were in the same configuration as illustrated in FIG. 1. The nails with the tape on top were heated to a temperature of 425° F. for a time of 3 minutes. Simultaneously an identical tape was applied to the opposite side of the nail configuration utilizing the same adhesion process conditions.

The resulting article was allowed to cool to room temperature. Adhesion of the tape to the nails was tested. Adhesion strengths of 15—30 lbs/in width were measured.

The resulting nail stack article, after passing the drop test, was tested in a pneumatic automatic nailer manufactured by the Paslode Division of Signode Corporation. The test results indicated that the nails performed extremely well in the pneumatic nailer. The results were far superior to those obtained using nail stacks bonded together with conventional adhesive techniques.

EXAMPLE 2

The technique of Example 1 is repeated, except that the nails are replaced with glass-fiber reinforced thermoplastic rods which are to be used as fastening elements.

EXAMPLE 3

Example 1 is repeated except that the steel nails are replaced with aluminum rods which are to be used as fastening elements.

EXAMPLE 4

Example 1 is repeated except that the steel nails are replaced with copper wires and the tape is low density ethylene polymer containing 10 wt. % of butyl rubber, the total composition grafted with 3 wt. % of acrylic acid.

EXAMPLE 5

A staple article according to the invention is prepared by arranging wire staple elements in an adjacent, touching, planar relationship. The elements while heated to a temperature exceeding that of the binder are covered with a thin film (about 3 mils) of the binder of Example 1.

EXAMPLE 6

Example 5 is repeated except that the elements are covered with a fine powder prepared from the binder of Example 1.

It is to be noted that the specific embodiments described above are for nail-stack fastener articles in which clip-head nails are the fastener elements.

Other types of nails can also be used in nail-stacks with suitable adjustments for the particular type of nail. For instance drywall nails have a full-head as opposed to the half-head of a clip-head nail. Therefore, they, of necessity, are placed further apart in the stack.

Preferably, when tapes are used for dry-wall nail stacks, they are notched, marked, or indented in the approximate middle of the span between each nail. This is so that the tape breaks in such a manner that each nail carries with it no more than its share of the tape binder.

I claim:

1. An article of manufacture comprising a plurality of fastening elements, arranged in a preselected configuration and held together in said configuration by a flexible binder composition wherein said binder composition is a blend of a $C_2$ to $C_8$ polyolefin material having a MFR of from 1 to 20 comprising 30 to 90 wt. % of a polyolefin plastic selected from the group consisting of isotactic polypropylene, high density polyethylene and mixtures thereof with 70 to 10 wt. % of an elastomer selected from the group consisting of ethylene-propylene copolymers, polybutylene and polyisobutylene, the composition grafted with from 1 to 20 weight percent of a graft component of a $C_3$ to $C_{10}$ unsaturated carboxylic acid or a glycidyl derivative thereof and wherein said binder is firmly adhered to the surfaces of said fastening elements, because of the adhesive functionality imparted by said graft component, wherein said binder composition has physical property values of:

(a) Secant Flexural Modulus,
(b) Izod Room Temperature Inpur Strength,
(c) Tensile Strength, and
(d) Adhesion, such that said binder adheres to each of said fastening elements without separating therefrom when each fastening element and a portion of binder adhered thereto are separated from said configuration and are driven into a material for fastening purposes.

2. An article according to claim 1 wherein said fastening elements are composed of any one of the following materials:

(a) ferrous,
(b) aluminum,
(c) glass-fiber reinforced plastic,
(d) copper,
(e) combinations of the foregoing.

3. An article according to claim 2 wherein said fastening elements are nails.

4. An article according to claim 2 wherein said fastening elements are wire staples.

5. An article according to claim 1 wherein said fastening elements are nails.

6. An article according to claim 1 wherein said fastening elements are wire staples.

7. An article according to claim 6 wherein said binder has been applied in the physical form of a film which substantially covers the exposed surface of said staples.

8. An article according to claim 1 wherein said binder composition has an ASTM D790 flexural modulus of 0.5 to 1.5, an ASTM D256 impact strength in ft/lbs/in. of notch of 1.3 to DNB at room temperature, an ASTM D638 tensile strength of 4,000 to 1,700 psi and adheres to said fastener elements with an adhesive strength of at least 10 and up to 30 lbs/in. width.

9. An article according to claim 8 wherein said polyolefin comprises a major proportion selected from the group consisting of $C_2$ homopolymers, $C_3$ homopolymers, and copolymers of $C_2$ nd $C_3$ monoolefins and mixtures of the foregoing.

10. An article according to claim 1 wherein said binder has been applied in any one of the following physical forms:

(a) tape,
(b) film,
(c) powder,
(d) combinations of the foregoing.

11. An article according to claim 1 wherein said carboxylic acid monomer is acrylic acid.

12. An article according to claim 1 wherein said derivative is glydicyl acrylate.

13. An article according to claim 1 wherein said elements are ferrous nails and said binder is a tape comprising a blend of about 60 percent polypropylene and about 40 weight percent of an ethylene-propylene rubber which blend has been grafted with about 4 weight percent of acrylic acid and which has a MFR of about 10 and a peel adhesion strength of 15–30 psi of width.

14. An article according to claim 1 wherein said binder composition has been applied in a physical form selected from the group consisting of tapes, films, powder, combinations of the foregoing, and has an ASTM D256 impact strength of 0.6 to DNB ft/lbs/in unnotched over the temperature range of from −40 to 150° F., an ASTM D638 tensile strength of 1,800 to 3,000 psi, and adheres to said fastener elements with an adhesion strength of at least 20 lbs/in$^2$.

15. An article according to claim 1 wherein said binder composition is a 10 MFR binder composition of matter comprising a blend of 50 to 70 wt. % $C_2$–$C_3$ plastic polyolefin with 50 to 30 wt. % EPR elastomer, the blend grafted with 4% acrylic acid or glycidyl acrylate and having a secant flexural modulus of 75,000 psi room temperature notched Izod impact strength of 1.7 to DNB ft/lbs/inch and a tensile strength of 1,500 to 2,000 psi.

16. A 10 MFR binder composition of matter comprising a blend of 50 to 70 wt. % $C_2$–$C_3$ plastic polyolefin with 50 to 30 wt. % EPR elastomer, the blend grafted with 4% of acrylic acid or glycidyl acrylate and having a secant flexural modulus of 75,000–90,000 psi, a room temperature notched Izod impact strength of 1.7 to DNB ft/lbs/inch, and a tensile strength of 1,500 to 2,000, such that said binder composition is capable of adhering to a plurality of fastening elements without separating from any one of said fastening elements when one of said fastening elements and a portion of said binder composition adhered thereto are driven into a material for fastening purposes.

17. A strip of fasteners for use in a rapid-acting fastener driving apparatus, comprising: a plurality of metal fasteners having elongated cylindrical shanks disposed in close general parallel relationship to define a gap between adjacent shanks, and acrylic acid grafted carrier means for connecting said fasteners to form said strip, said carrier means comprising a metal-adherent blend of polypropylene and an ethylene-propylene terpolymer plastic envelopes extending about a major portion of each half of said shanks, and having the properties of an adhesive bond without requiring a separate adhesive, each of said envelopes being of uniform thickness and having a pair of opposed portions each adhering respectively to opposite sections of the circumference of each shank during the entire driving action including entry into the workpiece, the carrier means between said envelopes extending into said adjacent gaps and defining therein between the envelope portions adhered to adjacent shanks recessed portions directed inwardly toward similar recessed portions between envelope portions secured to the opposite portions of the shanks, the bonding properties of the carrier means being such that the resistance to shear at the interface between the carrier and shank is greater than the shear resistance of the carrier material in the gap between two adjacent fasteners and greater than the resistance of the workpiece encountered when the fastener and carrier material penetrate same, thereby, securing said fasteners together into said fastener strip while permitting each respective envelope and fastener to be easily and cleanly sheared and driven into said workpiece, said ethylene-propylene terpolymer being ethylene-propylene rubber grafted with the acrylic acid.

18. A strip of fasteners as in claim 17, wherein the recessed portions are generally V-shaped.

19. A strip of fasteners as in claim 18, wherein said V-shaped portions on opposite sides of the nail shanks are spaced from each other.

20. A strip of fasteners as in claim 17, wherein the width of said gaps is substantially twice the thickness of said envelopes.

21. A strip of fasteners as in claim 17 in which the oppositely disposed plastic envelopes contact substantially one half of the circumference of the shanks and are in abutting relationship with each other between the shanks.

22. A strip of fasteners as in claim 17 in which the portions of the carrier means between the adjacent nail shanks are thinner than the plastic engaging the nail shanks to facilitate severing of the nails from the strip.

23. A strip of fasteners as in claim 17 in which the portions of the carrier means between the nail shanks are provided with perforations to facilitate separation of the nails from the strip.

24. A strip of nails for use in a rapid-acting fastener driving apparatus, comprising: a plurality of nails having elongated cylindrical shanks disposed in close generally parallel slightly spaced apart side-by-side relationship to define a narrow gap between each of the adjacent shanks, each of said nails being provided with an enlarged head having a chord section slightly spaced from the periphery of the corresponding shank by an amount matching said narrow gap, said nails being arranged with said heads overlapping in a stepped relationship; and carrier means for connecting said nails to form said strip, said carrier means comprising a metal-adherent blend of isotactic polypropylene and ethylene-propylene rubber plastic envelopes, said plastic envelopes comprising 30 to 90 weight percent of isotactic polypropylene and 70 to 10 weight percent of ethylene-propylene rubber said blend grafted with from 1 to 20 weight percent of acrylic acid said plastic envelopes extending about a major portion of each half of said shanks and of the same thickness at all points and having the properties of an adhesive bond without requiring a separate adhesive, each of said envelopes having opposed portions extending between adjacent ones of said gaps over opposite sections of the periphery of said shanks, each of said envelope portions being integral with adjacent envelope portions within said gap and forming with said adjacent portions are inwardly directed, generally V-shaped angle, with the width of said gap being substantially twice the thickness of said envelopes, said adjacent envelope portions being spaced from said opposed envelope portions within said gaps, the low and high temperature impact strength of the carrier and the bonding properties of the carrier means being such that the resistance to shear at the interface between the carrier and shank is greater than the shear resistance of the carrier material between two adjacent fasteners and greater than the resistance of lumber encountered when fastener and carrier material penetrate same, thereby securing said fasteners together into said fastener strip while permitting each respective envelope and fastener to be easily and cleanly sheared and driven into said lumber under the full range of temperatures at which the fasteners are being used.

25. A strip of fasteners for use in a rapid-acting fastener driving apparatus, comprising: a plurality of metal fasteners having elongated cylindrical shanks disposed in close generally parallel relationship, and an acrylic acid grafted carrier means for connecting said fasteners comprising a metal-adherent blend of polypropylene and an ethylene-propylene terpolymer plastic envelopes extending about a major portion of each half of said shanks and having the properties of an adhesive bond without requiring a separate adhesive, each of said envelopes being of uniform thickness and having a pair of opposed portions each adhering respectively to opposite sections of the circumference of each shank during the entire driving action including entry into the workpiece, the carrier means between said envelopes defining therein between the envelope portions adhered to adjacent shanks recessed portions directed inwardly toward similar recessed portions between envelope portions secured to the opposite portions of the shanks, the low and high temperature impact strength of the carrier and the adhesion properties of the carrier means to the metal fasteners and the cohesion properties of the carrier being such that the resistance to shear at the interface between the carrier and shank is greater than the shear resistance of the carrier material between two adjacent fasteners and greater than the resistance of lumber encountered when fastener and carrier material penetrate same, thereby securing said fasteners together into said fastener strip while permitting each respective envelope and fastener to be easily and cleanly sheared and driven into said lumber under the full range of temperatures at which the fasteners are being used, said ethylene-propylene terpolymer being an ethylene-propylene rubber grafted with the acrylic acid.

26. A strip of nails for use in a rapid-acting fastener driving apparatus, comprising: a plurality of nails having elongated cylindrical shanks disposed in close generally parallel slightly spaced apart side-by-side relationship to define a narrow gap between each of the adjacent shanks, each of said nails being provided with an enlarged head having a chord section slightly spaced from the periphery of the corresponding shank by an amount matching said narrow gap, said nails being arranged with said heads overlapping in a stepped relationship; and an acrylic acid grafted carrier means for connecting said nails to form said strip, said carrier means comprising a metal-adherent blend of polypropylene and an ethylene-propylene terpolymer plastic envelopes extending about a major portion of each half of said shanks and of the same thickness at all points and having the properties of an adhesive bond without requiring a separate adhesive, each of said envelopes having opposed portions extending between adjacent ones of said gaps over opposite sections of the periphery of said shanks, each of said envelope portions being integral with adjacent envelope portions within said gap and forming with said adjacent portions an inwardly directed, generally V-shaped angle, with the width of said gap being substantially twice the thickness of said envelopes, said adjacent envelope portions being spaced from said opposed envelope portions within said gaps, the low and high temperature impact strength of the carrier and the bonding properties of the carrier means being such that the resistance to shear at the interface between the carrier and shank is greater than the shear resistance of the carrier material between two adjacent fasteners and greater than the resistance of lumber encountered when fastener and carrier material penetrate same, thereby securing said fasteners together into said fastener strip while permitting each respective envelope and fastener to be easily and cleanly sheared and driven into said lumber under the full range of temperatures at which the fastener are being used said ethylene-propylene terpolymer being an ethylene-propylene rubber grafted with said acrylic acid.

27. A strip of fasteners for use in a rapid-acting fastener driving apparatus, comprising: a plurality of metal fasteners having elongated cylindrical shanks disposed in a close generally parallel relationship to define a gap between adjacent shanks, and an acrylic acid grafted carrier means for connecting said fasteners to form said strip, said carrier means comprising a metal-adherent blend of polypropylene and an ethylene-propylene rubber plastic envelopes said blend comprising 30 to 90 weight percent of isotactic polypropylene and 70 to 10 weight percent of of and ethylene-propylene rubber said blend grafted with from 1 to 20 weight percent of acrylic acid, said plastic envelopes extending about the major portion of each half of said shanks and having in the properties of an adhesive bond without requiring separate adhesive, each of said envelopes being of uniform thickness having a pair of opposed portions each adhering respectively to opposite sections of the circumference of each shank during the entire driving action including entry to the workpiece, the carrier means between said envelopes extending into said adjacent gaps and defining therein between the envelope portions adhered to adjacent shanks recessed portion directed inwardly toward similar recessed portions between envelope portions secured to the opposite portions of the shanks, the bonding properties of the carrier means being such that the resistance to shear at the interface between the carrier and shank is greater than the shear resistance of the carrier material in the gap between two adjacent fasteners and greater than the resistance of the workpiece encountered when the fastener and carrier material penetrate same, thereby securing said fasteners together into said fastener strip while permitting each respective envelope amd fastener to be easily and cleanly sheared and driven into said workpiece.

28. A strip of fasteners for use in a rapid-acting fastener driving apparatus, comprising: a plurality of metal fasteners having elongated cylindrical shanks disposed in close generally parallel relationship, and an acrylic acid grafted carrier means for connecting said fasteners to form said strip, said carrier means comprising a metal-adherent blend of isotactic polypropylene and an ethylene-propylene rubber plastic envelopes, said plastic envelopes having a MFR of from 1 to 20 and comprising 30 to 90 weight percent of isotactic polypropylene and 70 to 10 weight percent of ethylene-propylene rubber said blend grafted with from 1 to 20 weight percent of acrylic acid, said plastic envelope extending about a major portion of each half of said shanks and having the properties of an adhesive bond without requiring a separate adhesive, each of said envelopes being of uniform thickness and having a pair of opposed portions each adhering respectively to opposite sections of the circumference of each shank during the entire driving action including entry into the workpiece, the carrier means between said envelopes defining therein between the envelope portions adhered to adjacent shanks recessed portions directed inwardly toward similar recessed portions between envelope portions secured to the opposite portions of the shanks, the low and high temperature impact strength of the carrier and the adhesion properties of the carrier means to the metal fasteners and the cohesion properties of the carrier being such that the resistance to shear at the interface between the carrier and shank is greater than the shear resistance of the carrier material between two adjacent fasteners and greater than the resistance of lumber encountered when fastener and carrier material penetrate same, thereby securing said fasteners together into said fastener strip while permitting each respective envelope and fastener to be easily and cleanly sheared and driven into said lumber under the full range of temperatures at which the fasteners are being used.

* * * * *